US007580534B2

(12) United States Patent
Fischer

(10) Patent No.: US 7,580,534 B2
(45) Date of Patent: Aug. 25, 2009

(54) METHOD AND ARRANGEMENT FOR TRANSMITTING SIGNALS TO A HEARING AID

(75) Inventor: Eghart Fischer, Schwabach (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 701 days.

(21) Appl. No.: 11/072,944

(22) Filed: Mar. 3, 2005

(65) Prior Publication Data

US 2005/0201578 A1 Sep. 15, 2005

(30) Foreign Application Priority Data

Mar. 5, 2004 (DE) ..... 10 2004 010 868

(51) Int. Cl.
*H04R 25/00* (2006.01)

(52) U.S. Cl. ..... 381/314; 381/315

(58) Field of Classification Search ..... 381/315
See application file for complete search history.

(56) References Cited

U.S. PATENT DOCUMENTS 3,681,530 A * 8/1972 Manley et al. ..... 704/203
6,307,945 B1 * 10/2001 Hall ..... 381/315
2005/0100182 A1 * 5/2005 Sykes et al. ..... 381/315

FOREIGN PATENT DOCUMENTS

| | | |
|---|---|---|
| DE | OS 35 08 830 | 9/1988 |
| JP | 54007219 | 1/1979 |
| JP | 54007220 A | 1/1979 |
| JP | 5031488 U | 4/1993 |
| JP | 2002330497 A1 | 11/2002 |

OTHER PUBLICATIONS

Sykes et al., U.S. Appl. No. 60/519,149, filed Nov. 12, 2003, 25 pages.*

* cited by examiner

*Primary Examiner*—Walter F Briney, III
(74) *Attorney, Agent, or Firm*—Schiff Hardin LLP

(57) ABSTRACT

In a transmission apparatus for transmitting signals to a hearing device, as well as transmission and operating methods thereof, and a hearing aid apparatus, not only the acoustic path but also an electromagnetic path are used to transmit the same signal. So that the data rate can be reduced for low power consumption, only the envelope of the useful signal is transmitted electromagnetically. This allows a useful signal to be transmitted from one hearing device to another hearing device electromagnetically with low power consumption. The reception-end hearing device then restores the source signal, containing interference, with the electromagnetically transmitted envelope to produce an output signal.

8 Claims, 1 Drawing Sheet

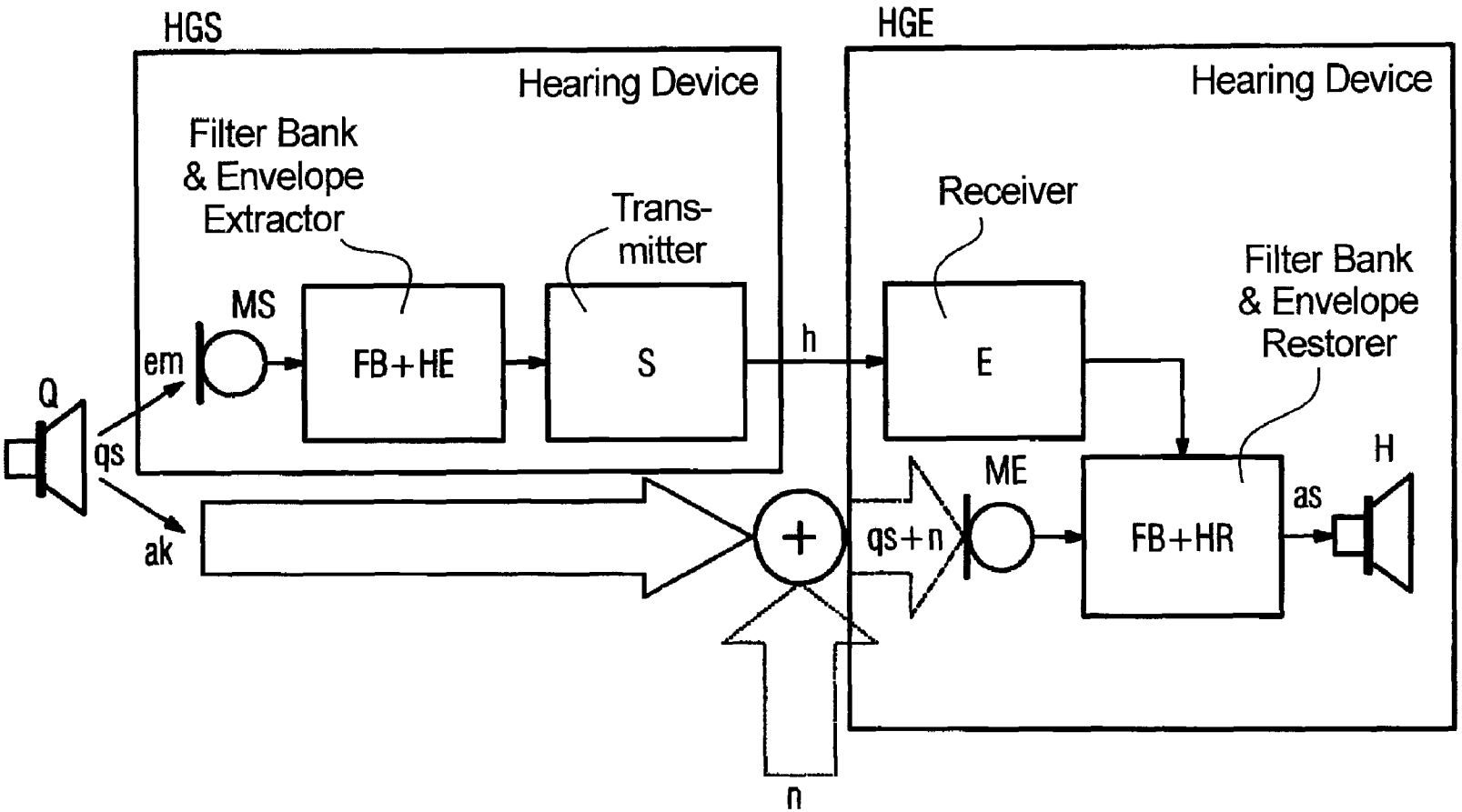
HGE
Hearing Device
Receiver
E
Filter Bank
& Envelope
Restorer
FB+HR
H
as
ME
qs+n
n
h
HGS
Hearing Device
Trans-
mitter
S
Filter Bank
& Envelope
Extractor
FB+HE
MS
em
qs
ak
Q

METHOD AND ARRANGEMENT FOR TRANSMITTING SIGNALS TO A HEARING AID

BACKGROUND OF THE INVENTION

1. Field of the Invention

The present invention relates to a transmission apparatus for transmitting signals to a hearing device of the type having a microphone device for picking up a sound signal and a transmission device for transmitting an electromagnetic signal. In addition, the present invention relates to a hearing aid apparatus of the type having a microphone device for picking up a sound signal, a signal generation device for generating a hearing aid output signal from the sound signal picked up, and a reception device for receiving an electromagnetic signal. The present invention also relates to methods for transmitting signals to a hearing device and for operating a hearing device.

2. Description of the Prior Art

In certain situations, it is not sufficient for a hearing device wearer to receive only the acoustically received signals in amplified form. The hearing device wearer may then not be able to hear or understand the signal from certain sound sources. In such cases, it would be appropriate to transmit the source signal, e.g. an output signal from the hearing device microphone of a party to a conversation who is likewise wearing a hearing device, or the output signal from an audio appliance, directly from this source to the hearing device wearer's hearing device. However, the available transmission data rate of hearing devices which can be produced today and in the near future is far below the data rate which would be required for this purpose—for reasons of power consumption as well.

In this context, FM systems are known which can be used to transmit electromagnetic signals to a hearing device. The transmitters used in this case are not hearing devices, however.

German OS 35 08 830 discloses a hearing device in which the earpiece is located outside the hearing device housing in an otoplastic body. The connection between an amplifier in the hearing device and the earpiece is made wirelessly. A sound signal picked up by the microphone is converted into an electrical signal in a known manner and is amplified using an amplifier. The wirelessly transmitted signal is picked up using an appropriate receiver in the otoplastic body and the audio-frequency signals obtained are forwarded to the earpiece.

SUMMARY OF THE INVENTION

An object of the present invention is to provide a transmission arrangement, a hearing aid, and transmission and operating methods therefor that achieve an improvement in the hearing of weak sound signals for hearing device wearers.

This object is achieved in accordance with the invention by a transmission apparatus for transmitting signals to a hearing device having a microphone device for picking up a sound signal, a transmission device for transmitting an electromagnetic signal, and a signal processing device for extracting an envelope from the sound signal picked up and for providing an envelope signal for the transmission device, so that the envelope signal can be transmitted electromagnetically.

The above object also is achieved in accordance with the present invention by a method for transmitting signals to a hearing device by picking up a sound signal and transmitting an electromagnetic signal, and also extracting an envelope from the sound signal picked up and providing an envelope signal, and transmitting the envelope signal electromagnetically.

The aforementioned object also is achieved by a hearing aid apparatus having a microphone device for picking up a sound signal, a signal generation device for generating a hearing aid output signal from the sound signal picked up, and a reception device for receiving an electromagnetic signal, the electromagnetic signal having an envelope for an original signal on which the sound signal picked up by the microphone device is based, and the envelope being able to be taken into account in the signal generation device when the hearing aid output signal is generated.

The above object also is achieved by a method for operating a hearing device by picking up a sound signal, generating a hearing aid output signal from the sound signal picked up, and receiving an electromagnetic signal, the electromagnetic signal having an envelope for an original signal on which the sound signal picked up is based, and the envelope being taken into account when the hearing aid output signal is generated.

It is thus advantageously possible to transmit an envelope signal containing little data instead of the entire audio signal and to use the spectrum of the remaining direct sound to ensure an acceptable sound quality.

Preferably, the inventive transmission apparatus can use the signal processing device to extract a plurality of envelopes in various frequency bands from the sound signal picked up. This means that the information to be transmitted can be reduced to a minimum.

The transmission apparatus may be in the form of a hearing device or in the form of an accessory which can be worn on the body. Specifically, a pocket hearing device or, by way of example, a sound pickup unit in the form of a ballpoint pen could thus be used as a transmitter.

Another significant advantage is achieved in an embodiment wherein the microphone device is a directional microphone. This allows the hearing device wearer to listen specifically to one sound source even when he has his hearing device switched to omnidirectional mode.

At the reception end, in an embodiment of the invention, the signal generation device modulates the sound signal picked up in line with the envelope or envelopes. Even if the sound signal picked up is then essentially equivalent to a noise signal, the envelope modulation can generate an entirely comprehensible signal. Naturally the better the sound signal picked up the better the sound quality of the modulated signal as well.

In a preferred embodiment, the hearing aid apparatus is also in the form of a hearing device. The low data rate which is needed means that it is thus possible to transmit from hearing device to hearing device. In this case, the transmission power is advantageously chosen such that the electromagnetic envelope signals are transmitted just a few meters. This is because at this distance it is still also possible to perceive signals via the acoustic route, for example in the case of normal conversation and under typical ambient conditions.

DESCRIPTION OF THE DRAWING

The single FIGURE is a signal flowchart for a transmission system based on the invention.

DESCRIPTION OF THE PREFERRED EMBODIMENTS

The exemplary embodiments outlined in more detail below are preferred embodiments of the present invention.

The FIGURE shows the communication between two hearing devices HGS and HGE in outline form. In this case, one of the two hearing devices HGS acts as a transmitter and the other hearing device HGE acts as a receiver.

A sound source Q emits a sound signal qs. This sound signal qs sets out on an electromagnetic path em and on an acoustic path ak. The electromagnetic path first of all leads to a microphone MS. The output signal from the microphone MS is broken down into spectral components in a filter bank FB, and an envelope extractor HE is used to extract envelopes from all of the frequency bands. The envelope signals are supplied to a transmitter S which transmits the envelopes h electromagnetically to the reception-end hearing device HGE or to its receiver E.

In its acoustic path ak, the source signal qs is subjected to noise n which alters or destroys the envelope of the useful signal qs. The summed signal qs+n is picked up by the microphone ME in the hearing device HGE. The output signal from the microphone ME is likewise broken down into frequency bands in a filter bank FB. An envelope restorer HR is used to restore the original envelope of the source signal qs as far as possible by using the envelopes received by the receiver E. This restored signal is forwarded as output signal as with a restored envelope to an earpiece H in the reception-end hearing device, so that a corresponding acoustic signal can be output.

To attain an output signal as of high sound quality, it is necessary for at least a portion of the source signal qs to be transmitted via the acoustic path ak. The design of the transmitter S therefore can be relatively weak. A transmitter range in which the hearing device wearer can at least still receive a portion of the sound energy which is output by the sound source directly is sufficient. Typically, a range of below 10 m is sufficient for this.

The transmitter thus transmits only the envelope h of the sent signal, possibly on a frequency-specific basis in a plurality of bands, to the receiver, which in turn impresses it on its directly received, acoustic signal spectrum, which contains direct sound components, and thus provides a significantly better representation of the signal sent by the sound source Q than the direct sound signal which is picked up by the receiver hearing device HGE and has noise added to it on the transmission path.

In this way, the data rate for electromagnetically transmitting a few envelopes can be significantly reduced in comparison with an otherwise necessary data rate for transmitting a full audio signal. It is entirely possible to achieve a reduction in the data rate by a factor of between 40 and 400 with this type of transmission, since in this case a sampling frequency of 100 Hz generally is sufficient for envelope transmission. This is because it is known from voice synthesis that the largest of all portion of the information in speech is contained in a few frequency-specific envelopes. As already mentioned, these envelopes can be impressed onto bandpass noise signals, for example, and in this way comprehensible speech can be produced again. In line with the present invention, however, the sound quality is significantly improved by virtue of it being possible to resort to original frequency components from the spectrum of the source signal.

The microphone MS in the transmission-end hearing device HGS may be the conventional hearing device microphone or better still an additional bone conduction microphone that can pick up the voice signal without interference.

As noted above, the transmission unit does not need to be in the form of a hearing device. Rather, it is also possible to integrate the inventive envelope transmitter into an arbitrary accessory. This can then be placed in the vicinity of a sound source, e.g. on the television, in the center of a conference table etc., or can be worn on the body. Thus, for example, the envelope transmitter may be in the form of a pen and may be worn in a shirt pocket.

Although modifications and changes may be suggested by those skilled in the art, it is the intention of the inventor to embody within the patent warranted hereon all changes and modifications as reasonably and properly come within the scope of his contribution to the art.

I claim as my invention:

1. A hearing apparatus comprising:

a microphone device for picking up a sound signal, said sound signal being based on an original signal;

a reception device for receiving an electromagnetic signal comprised of an envelope of said original signal; and a sound generation device for generating a hearing aid output signal by modulating said sound signal based on said envelope of said electromagnetic signal received by said reception device.

2. A method for operating a hearing device comprising:

picking up a sound signal, said sound signal being based on an original signal;

receiving an electromagnetic signal comprising an envelope for said original signal; and generating a hearing aid output signal by modulating said sound signal based on said envelope.

3. A hearing apparatus comprising:

a microphone device for picking up a sound signal, said sound signal being based on an original signal;

a reception device that receives a plurality of electromagnetic signals comprising a plurality of envelopes of said original signal in respective frequency bands; and a sound generation device that generates a hearing aid output signal from said sound signal and said plurality of envelopes of said electromagnetic signal received by said reception device, by modulating said sound signal dependent on said envelopes.

4. A method for operating a hearing device comprising the steps of:

picking up a sound signal, said sound signal being based on an original signal;

receiving an electromagnetic signal comprising a plurality of envelopes of said original signal in respective frequency bands; and generating a hearing aid output signal from said sound signal and said plurality of envelopes of said electromagnetic signal, by modulating said sound signal dependent on said plurality of envelopes.

5. A method for transmitting a signal to an electro-acoustic transducer, comprising the steps of:

from a signal source that emits an original signal having an electromagnetic component and an acoustic component, detecting said electromagnetic component with a first microphone;

from the detected electromagnetic component, extracting at least one envelope of said original signal;

said acoustic component being subject to distortion, and detecting the distorted acoustic component of said original signal with a second microphone, said second microphone emitting a second microphone output signal representing the detected, distorted acoustic component of said original signal;

electronically applying said at least one envelope to said second microphone output signal to substantially restore the distorted acoustic component therein to said acoustic component emitted by said signal source, as a restored signal; and making the restored signal available as an output signal for transmittal to an electro-acoustic transducer.

6. A method for generating an audio signal, comprising the steps of:

from a signal source that emits an original signal having an electromagnetic component and an acoustic component, detecting said electromagnetic component with a first microphone;

from the detected electromagnetic component, extracting at least one envelope of said original signal;

said acoustic component being subject to distortion, and detecting the distorted acoustic component of said original signal with a second microphone, said second microphone emitting a second microphone output signal representing the detected, distorted acoustic component of said original signal;

electronically applying said at least one envelope to said second microphone output signal to substantially restore the distorted acoustic component therein to said acoustic component emitted by said signal source, as a restored signal; and in an electro-acoustic transducer, converting said restored signal into an audio output signal.

7. A device for transmitting a signal to an electro-acoustic transducer, comprising:

a first microphone that detects an electromagnetic component of an original signal emitted from a signal source, said original signal emitted from said signal source also comprising an acoustic component that is subject to distortion upon emission from said signal source;

an envelope extractor supplied with the detected electromagnetic component from said first microphone, said envelope detector extracting at least one envelope of said original signal from the detected electro-magnetic component;

a second microphone that detects the distorted acoustic component of said original signal, said second microphone emitting a second microphone output signal representing the detected, distorted acoustic component of said original signal;

a processor supplied with said at least one envelope and with said second microphone output signal, that electronically applies said at least one envelope to said second microphone output signal to substantially restore the distorted acoustic component therein to the acoustic component emitted by said signal source, as a restored signal, and that makes the restored signal available as a processor output signal for transmittal to an electro-acoustic transducer.

8. A device for generating an audio signal, comprising:

a first microphone that detects an electromagnetic component of an original signal emitted from a signal source, said original signal emitted from said signal source also comprising an acoustic component that is subject to distortion upon emission from said signal source;

an envelope extractor supplied with the detected electromagnetic component from said first microphone, said envelope detector extracting at least one envelope of said original signal from the detected electro-magnetic component;

a second microphone that detects the distorted acoustic component of said original signal, said second microphone emitting a second microphone output signal representing the detected, distorted acoustic component of said original signal;

a processor supplied with said at least one envelope and with said second microphone output signal, that electronically applies said at least one envelope to said second microphone output signal to substantially restore the distorted acoustic component therein to the acoustic component emitted by said signal source, as a restored signal; and an electro-acoustic transducer supplied with said restored signal that transduces said restored signal into an audio output signal.

* * * * *